US008607518B2

(12) United States Patent
Smith

(10) Patent No.: US 8,607,518 B2
(45) **Date of Patent: *Dec. 17, 2013**

(54) WALL PANEL WITH EXTENDED INTEGRAL POST

(71) Applicant: Rodney I. Smith, Midland, VA (US)

(72) Inventor: Rodney I. Smith, Midland, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/788,270

(22) Filed: Mar. 7, 2013

(65) Prior Publication Data

US 2013/0186025 A1 Jul. 25, 2013

Related U.S. Application Data

(63) Continuation-in-part of application No. 12/883,476, filed on Sep. 16, 2010, now Pat. No. 8,407,956.

(60) Provisional application No. 61/611,203, filed on Mar. 15, 2012.

(51) Int. Cl.
*E02D 27/18* (2006.01)
*E04C 2/30* (2006.01)

(52) U.S. Cl.
USPC ..... 52/297; 52/745.1

(58) Field of Classification Search
USPC ..... 52/745.1, 745.09, 721.2, 855, 297, 250; 256/13.1, 19
See application file for complete search history.

(56) References Cited

U.S. PATENT DOCUMENTS

| | | | | | |
|---|---|---|---|---|---|
| 1,467,470 | A * | 9/1923 | Borg | 405/262 |
| 1,544,863 | A * | 7/1925 | Ross | 52/295 |
| 3,991,532 | A * | 11/1976 | Buxbom | 52/297 |
| 4,386,762 | A * | 6/1983 | Collins | 256/59 |
| 4,434,600 | A * | 3/1984 | Backman | 52/742.15 |
| 4,519,729 | A * | 5/1985 | Clarke et al. | 405/129.6 |
| 5,501,057 | A * | 3/1996 | Dawson | 52/761 |
| 5,524,405 | A * | 6/1996 | Byrd | 52/295 |
| 5,689,927 | A * | 11/1997 | Knight, Sr. | 52/297 |
| 5,887,404 | A * | 3/1999 | Kreizinger | 52/592.1 |
| 6,000,182 | A * | 12/1999 | Keenan | 52/295 |
| 7,802,409 | B2 * | 9/2010 | Stott | 52/295 |

FOREIGN PATENT DOCUMENTS

JP 59224727 A * 12/1984 ..... E02D 27/42

* cited by examiner

*Primary Examiner* — Christine T Cajilig
(74) *Attorney, Agent, or Firm* — Whitham, Curtis, Christofferson & Cook, P.C.

(57) ABSTRACT

A wall module for a modular wall structure integrates a wall panel portion with a post portion having top or upper and bottom or lower extensions and at least one groove for receiving a distal end portion of a wall panel portion of an adjacent module. The bottom/lower extension is set within an exposed portion of a reinforcing cage of a caisson or pier extending below grade and the reinforcing cage and bottom/lower extension are encapsulated with a material such as concrete to integrate the caisson or pier with the bottom/lower post extension. Alternatively, the bottom post extension can be formed to have a length sufficient to support the module in soil and a pier or caisson integrally formed therewith by pouring concrete around the bottom post extension within a post hole.

20 Claims, 5 Drawing Sheets

WALL PANEL WITH EXTENDED INTEGRAL POST

CROSS-REFERENCE TO RELATED APPLICATIONS

This application is a continuation-in-part of U.S. patent application Ser. No. 12/883,476, filed Sep. 16, 2010, which claims priority of U.S. Provisional Patent Application 61/243,823, filed Sep. 18, 2009, both of which are hereby incorporated by reference in their entireties. Priority of both of these applications is claimed as to all common subject matter. This application also claims priority of U.S. Provisional Patent Application 61/611,203, filed Mar. 15, 2012, which is also hereby incorporated by reference in its entirety.

FIELD OF THE INVENTION

The present invention generally relates to wall panels and, more particularly to prefabricated wall panels for uses such as acoustic barriers along highways, retaining walls and the like.

BACKGROUND OF THE INVENTION

Population growth of cities and towns in recent years has caused residential and commercial development of large areas of land around such cities and towns. Increased densities and speeds of traffic have thus been necessitated for travel to and within such areas, requiring many new roadways or roadway improvements (e.g. additional roadway lanes) while increased population density and land values have required utilization of land which often abuts major traffic thoroughfares where relatively high levels of noise are present. Such noise will often be communicated to nearby properties where the noise may interfere with desired uses of such property.

In recent years, walls have been constructed to function as acoustic baffles or barriers in an effort to reduce noise levels at locations adjacent to roadways where commercial, high density and/or high speed traffic is present. Such walls must be sturdily built of materials which are not easily damaged by weather conditions such as high winds or by possible impact from vehicles. The walls must also be relatively tall (e.g. eight feet to thirty feet or more) and must be securely anchored, requiring support posts to be of extreme length, generally twenty-five feet greater than the wall height or fastened to reinforced concrete caissons extending to a twenty-five foot or greater depth in the ground. Such a fastening has generally been accomplished by having large bolts embedded in or attached to the caisson using a flange and a complementary flange affixed to the post which can thus be affixed to the caisson below grade level and the connection then encapsulated with concrete to fill the remainder of the post hole above the caisson. Both the provision of a flange of sufficient robustness and the attachment of the post to the caisson contribute substantially to the overall cost of the wall system. Moreover, such structures and operations also required the posts to be installed several days prior to the installation of the wall sections (usually provided as panels of a standard height which are then essentially stacked edge-to-edge in grooves in the posts) in order for the concrete fill to cure adequately to carry loads imposed by the wall segments and their installation. Thus the installation of posts and installation of wall panel segments in separate operations increases the duration of construction time, the amount, types and movement of machinery required and the amount of labor involved, further contributing to cost of such walls. Further, such large structures may be required for both sides of substantial lengths of roadway and can thus add significantly to costs of roadway construction or improvement.

These factors favor construction of such barriers from large standardized wall panels of pre-cast concrete which are supported in grooves of some construction such as wide flanged or H-shaped steel beams which are anchored securely in the ground. However, for aesthetic as well as maintenance cost reasons, cast concrete posts having opposing grooves to receive the wall segments have been favored in recent years even though difficulties are presented in providing such opposed grooves of sufficient strength and accuracy.

In any case, somewhat different machinery has been required to anchor the posts in the ground with highly accurate spacing to receive ends of wall panels and to assemble the wall panels to them in separate operations. Further, if damage or settling occurs, the posts could shift and possibly allow the wall panels to become detached therefrom, particularly where wall panels of standardized size are stacked edge-to-edge, as alluded to above. Moreover, when a wall is built on terrain which is other than flat, such as where a grade is present, the bottom-most wall panels will generally reach the ground at only one corner, causing unbalanced and uncontrolled stresses in the wall which are transferred to the posts; aggravating any shifting which may occur and possibly causing wall failure.

SUMMARY OF THE INVENTION

It is therefore an object of the present invention to provide a wall section or module with integrated post and panel wherein the post portion is extended beyond the top of the wall panel portion by a distance sufficient to accommodate the terrain elevations on which a wall is built using the integrated post and panel sections in accordance with the invention and beyond the bottom of the wall panel portion by a length sufficient for support of the wall section even if shifting or settling occurs.

It is another object of the invention to provide a wall section which minimizes unbalanced stresses transferred to posts and/or adjacent wall sections.

It is a further object of the invention to provide an integrated post and panel structure which allows the construction of a wall in a single set of operations at the location of each respective post and panel structure location.

In order to accomplish these and other objects of the invention, a module for construction of a wall is provided comprising a panel portion integrally formed with a post portion including a groove for receiving a distal end of a panel portion of an adjacent module, a top post extension portion for accommodating the entirety of the distal portion of the panel portion of the adjacent module when the module and the adjacent module are installed at different heights, and a bottom post extension portion of a length sufficient to support the module in soil for being integrated with a pier or caisson.

In accordance with another aspect of the invention, a modular wall comprising a plurality of wall modules is provided, each wall module comprising a panel portion integrally formed with a post portion, said post portion including a groove for receiving a distal end of a panel portion of an adjacent module, a top post extension portion for accommodating said distal portion of said panel portion of said adjacent module when said adjacent module and said module are installed at different heights, and a bottom post extension portion, the modular wall further comprising a caisson or pier integrated with the bottom post extension portion of the wall module which is of a length sufficient to support the wall module in soil.

In accordance with a further aspect of the invention, a method of constructing a modular wall is provided including steps of forming a post hole to a desired depth, positioning a wall module comprising a panel portion integrally formed with a post portion including a groove for receiving a distal end of a panel portion of an adjacent module, and a bottom post extension portion such that said bottom post extension portion is of a length sufficient to support the wall module in soil and said distal end of said wall portion is received in said groove of an adjacent module, and pouring a material to encapsulate the bottom extension portion of the wall module.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
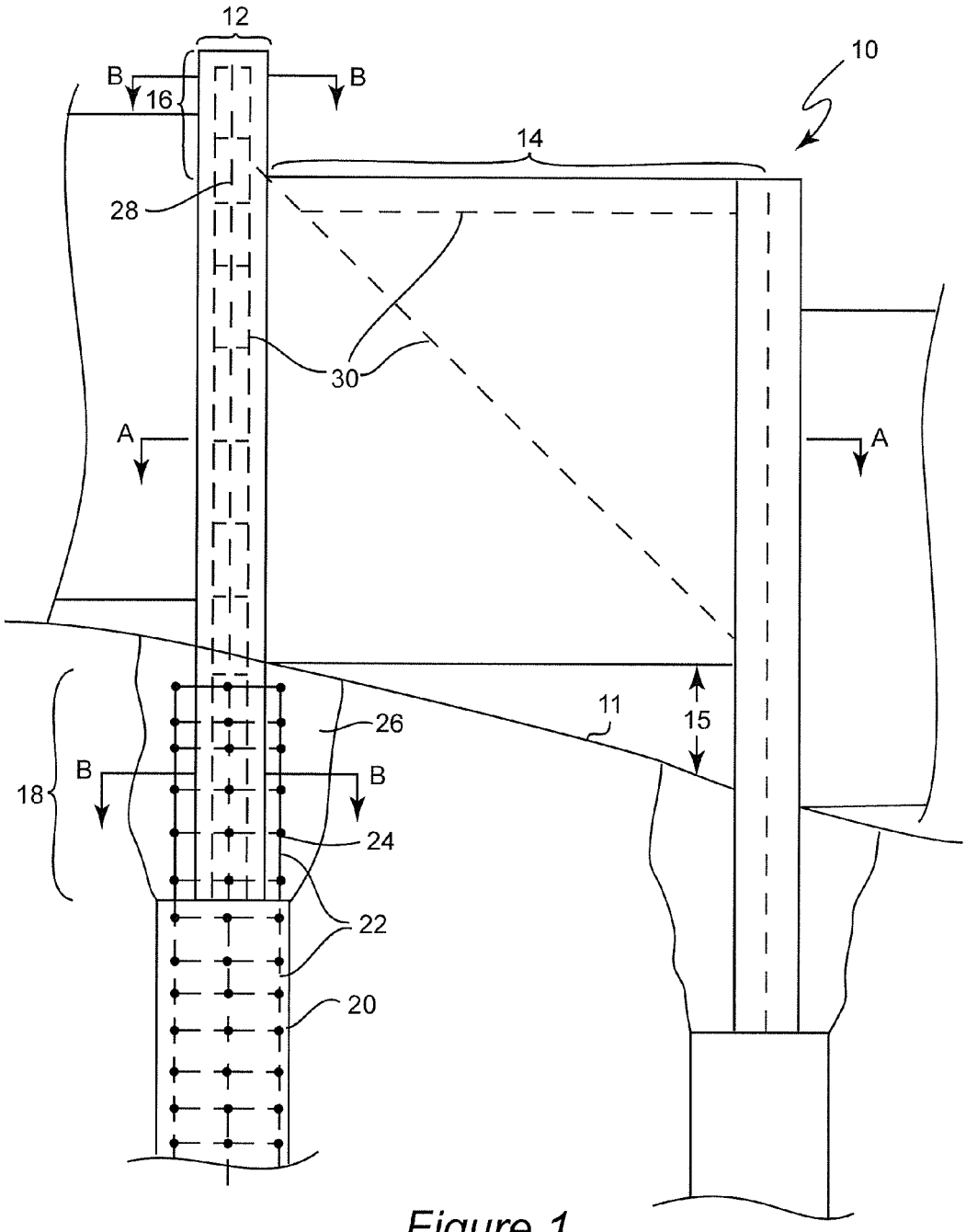
FIG. 1 is an elevation view of an integrated wall and post section in accordance with the invention as assembled with another wall and post section in a completed wall.
Figure 2:
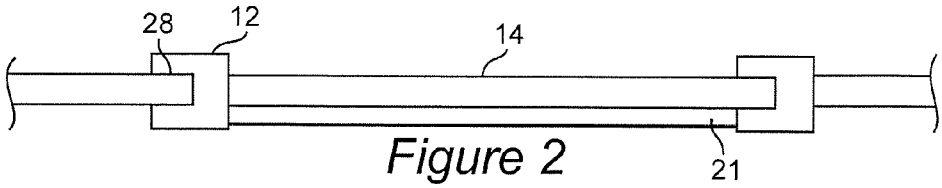
FIG. 2 is a top view of an integrated wall and post section in assembled with an adjacent integrated wall and post section in accordance with the invention.

Referring now to the drawings, and more particularly to FIGS. 1 and 2, there are shown elevation and top views of an integrated post and panel section, respectively, as assembled with adjacent post and panel sections or modules in a completed wall. While the invention will be described in connection with an application as an acoustic barrier in which application it is deemed to be particularly advantageous, it should be understood that the principles of the invention may be embodied in numerous ways and with modifications which may be more or less specific to other particular applications such as retaining walls or even habitable or storage structures. In this regard, the panel section may have any decorative and/or sound absorbing coating or material layer or any other surface treatment 21 applied thereto or integrated therewith, as depicted in FIG. 2, to enhance appearance or performance of the module 10 or structure formed therefrom, in accordance with the intended use of the structure.

The invention principally comprises a novel integrated wall and post section for a wall, sometimes referred to as a post and panel structure or module 10 including an extended post portion that may be embedded in and thus integrated with a pier or caisson and which, when assembled with other similar sections or modules, forms a wall of enhanced strength and structural robustness which greatly reduces transfer of uncontrolled forces to other wall sections and to posts and which can be transported and assembled in a substantially continuous process which can be performed with high efficiency and much reduced cost compared with other modular wall systems in which the post and wall panel portions are not integrated. Specifically, in accordance with the invention, only a single basic shape of module is used although the modules can be varied in dimensions and some details as circumstances or a given wall design, site or installation may require as will be discussed in greater detail below.

Figure 4:
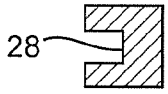
FIG. 4 is a cross-sectional view of the post portion extensions of a single integrated wall and post section in accordance with the invention at either of sections B-B shown in FIG. 1.
Figure 3:
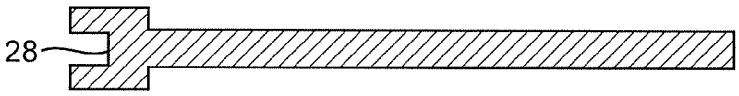
FIG. 3 is a cross-sectional view of a single integrated wall and post section in accordance with the invention at section A-A indicated in FIG. 1.
Figure 5:
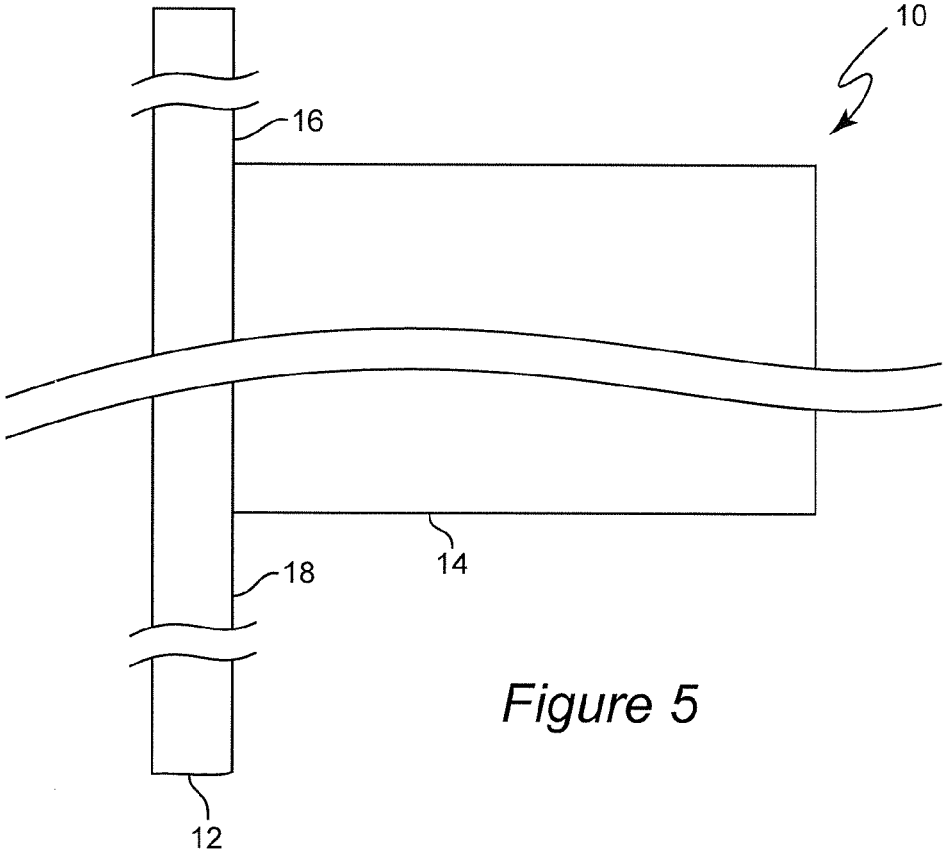
FIG. 5 is an elevation view of a single integrated wall and post section in accordance with the invention.
Figure 6:
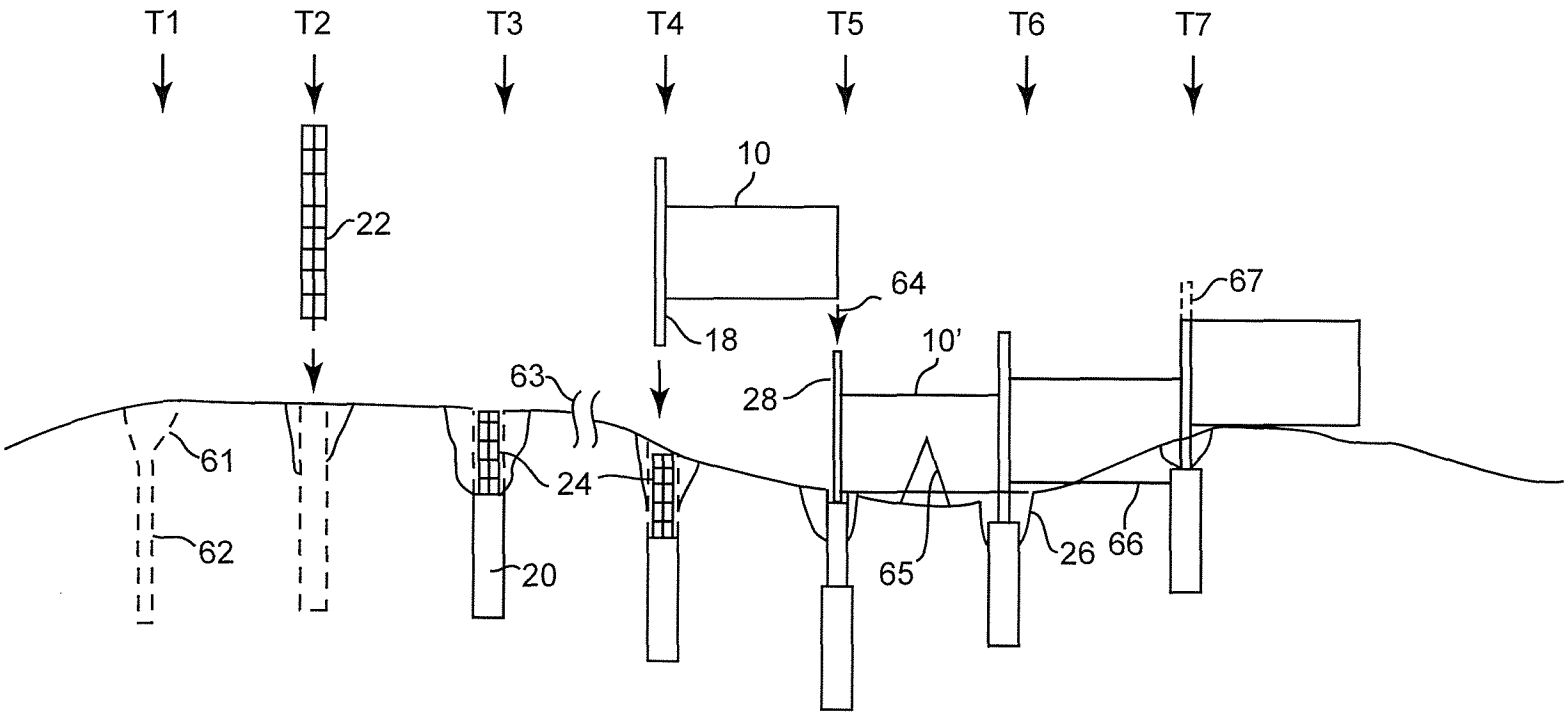
FIG. 6 illustrates construction of a wall using the integrated post and panel sections or modules in accordance with the invention such that installation can be accomplished with a single series of operations at each post and panel location.

In the elevation view of FIG. 1, the overall shape of the integrated post an panel module 10 somewhat resembles a flag flying from a flagpole or a "T" shape turned on its side, as is most evident in the depiction of FIG. 5 and in FIG. 6. Specifically module 10 comprises a post portion 12 and a panel portion 14 which are integrally formed of a one-piece construction that is preferably cast from concrete or concrete-bonded aggregate or the like for strength and resistance to weather and impact damage. The post portion 12 includes a single groove 28 along at least the upper portion thereof but preferably over its entire length, as illustrated in the cross-sections illustrated in FIGS. 3 and 4, and extensions 16, 18 at the top and bottom of module 10 which extend for a distance beyond the top and bottom of the panel portion 14.

The lengths of these extensions is somewhat arbitrary but it is preferred for the extension 16 to be at least equal to the maximum change in grade 11 per "post-to-post" distance (e.g. effective installed horizontal module length). Such a length of extension 16 assures that the entire height of the distal end of the panel portion 14 is received in the groove 28 of the adjacent module 10. Any excess length of extension 16 due to less severe changes in height of grade 11 can be optionally removed once assembly of the wall is substantially complete. The length of extension 18 is also somewhat arbitrary and will generally be specified in the wall design or specifications. A nominal length of extension 18 is about five feet but may be greater to provide greater strength (e.g. for resisting wind loading on the wall of a given height to withstand typical nominal wind velocities of eighty miles per hour).

Internal reinforcement is generally provided as generally indicated by reference numeral 30 but particulars thereof are not important to the invention or performance or meritorious effects thereof in accordance with the basic principles of the invention. The particulars of reinforcement will typically be designed in accordance with specifications for each given wall installation such that each panel and post module can be supported by the bottom post extension under maximum anticipated adverse weather or impact conditions.

It should be appreciated in this regard that, while the panel and post modules are ideally designed to be self supporting solely through the bottom post portion extension 18 even though the panel portion 14 is cantilevered therefrom, when assembled with other modules as illustrated in FIGS. 1 and 2 will also be supported, particularly under conditions of loading by being fitted to the groove 28 in an adjacent panel and post module 10. This additional support allows reduction of the load borne by the post portion extension 18 of each respective module 10. The extension 18, once installed, as will be discussed below, thus provides a very substantial safety margin of structural robustness to resist wind loading and the like. Additionally, being integrally formed, the wall panel section cannot become detached from the post portion of the module even if severe shifting or settling causes detachment/disengagement from the adjacent module; increasing safety of the completed wall and modules thereof and limiting cost and complexity of required repairs should such shifting or settling occur of be caused by severe conditions. That is, even if the wall portion becomes disengaged from an adjacent module and is thus cantilevered from the post, the integration with a caisson or pier will prevent the wall portion from falling.

Figure 2A:
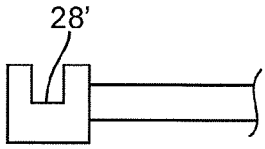
FIG. 2A is a top view of a variant form of the invention.

In this regard, a variant form of the invention, an example of which is illustrated in FIG. 2A allows angular turns to be made in the wall which can yield a serpentine shape in the wall as seen in plan view and which can greatly enhance the strength of the completed wall as well as providing the invention to be used for retaining walls and habitable or storage structures as alluded to above. The angle at which an adjacent panel is accommodated can be varied at will in accordance with any desired design and is not limited to the exemplary 90° illustrated. As a further variant embodiment of the invention, a groove 28' as shown in FIG. 2A can be provided in addition to groove 28 for using a post and panel wall section as a buttress to further enhance wall strength and stability and possibly acoustic effectiveness.

With further reference to FIG. 1, the anchoring of post and panel modules in accordance with the invention sufficient to support the post and panel modules 10 through extension 18 will now be discussed. It should be understood that walls such as are used for acoustic barriers are largely free-standing and thus require particularly robust and rigid anchorage extending for a substantial depth of twenty-five feet or more into the ground. Early designs of such acoustic barriers using steel beams as posts could be driven into the ground using pile drivers or the like and additional required length provided by welding additional lengths of steel beams thereto as the beams were driven into place.

However, for structural reasons, the greater rigidity of pre-cast reinforced concrete later became the structure of choice for posts even though additional length (e.g. the sum of the required depth into the ground and the height of the wall design) could not be produced on site and presented severe difficulties of transportation of posts to the wall construction site. To solve the transportation problem and provide additional wall strength and stability, concrete piers having greater mass and weight than the bottom portions of pre-cast posts became the design of choice since the concrete piers (often referred to somewhat incorrectly as "caissons") could be manufactured on-site or in-situ by inserting a pre-assembled reinforcement cage with substantial bolts integrally formed therewith into a post hole that could be drilled into undisturbed soil and the concrete pier or caisson poured in place. The posts could then be attached to the bolts and thus to the concrete pier or caisson using a flange integrally formed with the posts and the joint between the pier or caisson and the post embedded in concrete by a further in-situ pour. Even though the use of an expensive to provide flange and the labor involved in affixing the flange to the pier or caisson using bolts, some economies were achieved since posts and reinforcement cages were then of lengths that could be accommodated by trucks of common design.

In accordance with the invention, the bottom extension of the post and panel module allows further economies to be achieved. Specifically, the invention provides for the concrete pier or caisson 20 to be formed by placing a reinforcing cage 22 in a post hole in the known manner but pouring the concrete pier or caisson only to the depth to which the bottom post portion extension will reach and leaving a length 24 of the reinforcement cage substantially equal to the length of post portion extension 18 exposed. The post portion extension 18 can then be lowered into the space within the exposed reinforcing cage portion 24 as the post and panel module 10 is set in place. The location of module 10 is then preferably supported in the correct position by temporary structures as well as by interlocking with groove 28, 28' of the adjacent module. Then the concrete pier or caisson is completed by an additional concrete pour 26 which preferably reaches substantially to grade level. The pour 26 is thus precisely complementary to the post portion extension 18 and becomes substantially integral therewith due to inclusion of the reinforcement cage 22 surrounding post portion extension 18. The bonding to extension 18 and pier or caisson 20 may be enhanced through surface treatment of the extension 18 and/or use of commercially available bonding agents which can be applied thereto in liquid form although the potential benefit thereof is not believed to be significant relative to the strength obtained through the final structure itself. Once pour 26 has been allowed to cure for a suitable period of time (e.g. several days), the temporary support can be removed and the installation of a given post and panel module is complete.

It should be appreciated that the assembly and construction technique described above not only provides a structure of increased rigidity, robustness and stability, but does so using modules and reinforcement cages which need not be of a length to require special equipment for transportation. For example, numerous wall modules 10 may be carried in a stacked configuration or with the panel portions (which generally extend about five to eight feet) oriented vertically on a flat bed truck. Further, it should be appreciated from the cross-sections of the integral post and panel module shown in FIGS. 3 and 4 that the modules 10 can be easily, rapidly and inexpensively cast by any of a number of techniques familiar to those skilled in the art, including extrusion, battery moulds and/or so-called slip form casting. Moreover, it should also be appreciated that the wall assembly and construction technique described above also allows a progressive sequence of operations to be performed which can be completed in substantially reduced time and with minimized movement of equipment; allowing significant reduction of costs as will now be explained with reference to FIG. 6.

In FIG. 6, the preferred assembly and construction technique of a wall including the invention is depicted as proceeding from right to left. Accordingly, the earliest step is depicted at the left and the sequence of operations at a given location should be considered as being depicted from left to right as denoted by the time sequence indicators T1-T7. Preferably, each operation in the sequences T1-T7 will be performed by a specialized crew that performs the same operation at a sequence of locations along the route of the wall to be constructed with each crew being followed by another crew specialized and equipped for performing the next operation in the sequence.

The process begins with preparation of a post hole which will include an enlarged portion 61 and a drilled portion 62 which extends to a substantial depth in undisturbed soil and well past any so-called freeze line or depth as depicted at sequence T1. At sequence T2, a reinforcement cage 22 (FIG. 1) is lowered into the drilled hole 62 and properly positioned relative to the walls thereof. Then, at sequence T3, the concrete pier or caisson 20 is poured in-situ, as alluded to above, to a level which can be substantially reached by extension 18. Alternatively, operations T2 and T3 can be combined using a pre-cast concrete pier or caisson fabricated such that a portion of the reinforcement cage protrudes therefrom by a distance substantially equal to the length of extension 18. In this case, concrete can be poured prior to and around the pre-cast pier or caisson to obtain the correct vertical location thereof. However, this alternative requires handling of much increased weight and substantially critical positioning and is thus not preferred. In either case, it is preferred to provide an adequate time interval prior to completing the assembly and construction sequence for adequate curing of concrete pour 20 (or pours incident to positioning a pre-cast concrete pier or caisson).

When the concrete thus poured has cured sufficiently, an integrated post and panel module 10 is placed such that post portion extension 18 is positioned within the exposed portion 24 of reinforcement cage 22 as alluded to above and as indicated at sequence T4. Positioning of the currently placed module 10 is facilitated by inserting the distal end of the panel portion 14 into groove 28 on a previously placed module 10' as indicated by arrow 64 although such insertion or even previous installation (or, possibly, merely positioning) of an adjacent module as indicated at sequence T5 are not required. Then, at sequence T6, the concrete pier or caisson is completed with extension 18 embedded therein by a further concrete pour 26, as alluded to above. It should be noted that while it is not necessary for any panel portion to enter the ground and a substantial gap may be permitted between the bottom of the panel portion and the existing grade (since substantial noise attenuation will be achieved at ground level by vegetation or the like). In some cases it may be desirable for part of the panel portion to be below grade, possibly for support in addition to or in place of any temporary support structure such as scaffolding 65 which may be provided to support the modules 10 during curing of pour 26 as shown at 66. Once pour 26 has sufficiently cured, supports 65 can be removed and the wall portion to the right of operation sequence T7 is complete although any excess height of extension 16 can be optionally removed.

Thus it is seen that the basic invention as described above provides not only a wall structure of improved robustness and stability but also provides for convenient manufacture and transportation and reduced cost of field assembly which can be performed in much reduced time and much reduced required machinery and movement thereof. However, for most soil types, reinforcement of the caisson can be omitted if the lower post portion extension is of a length to extend the full required depth of the caisson.

Figure 7:
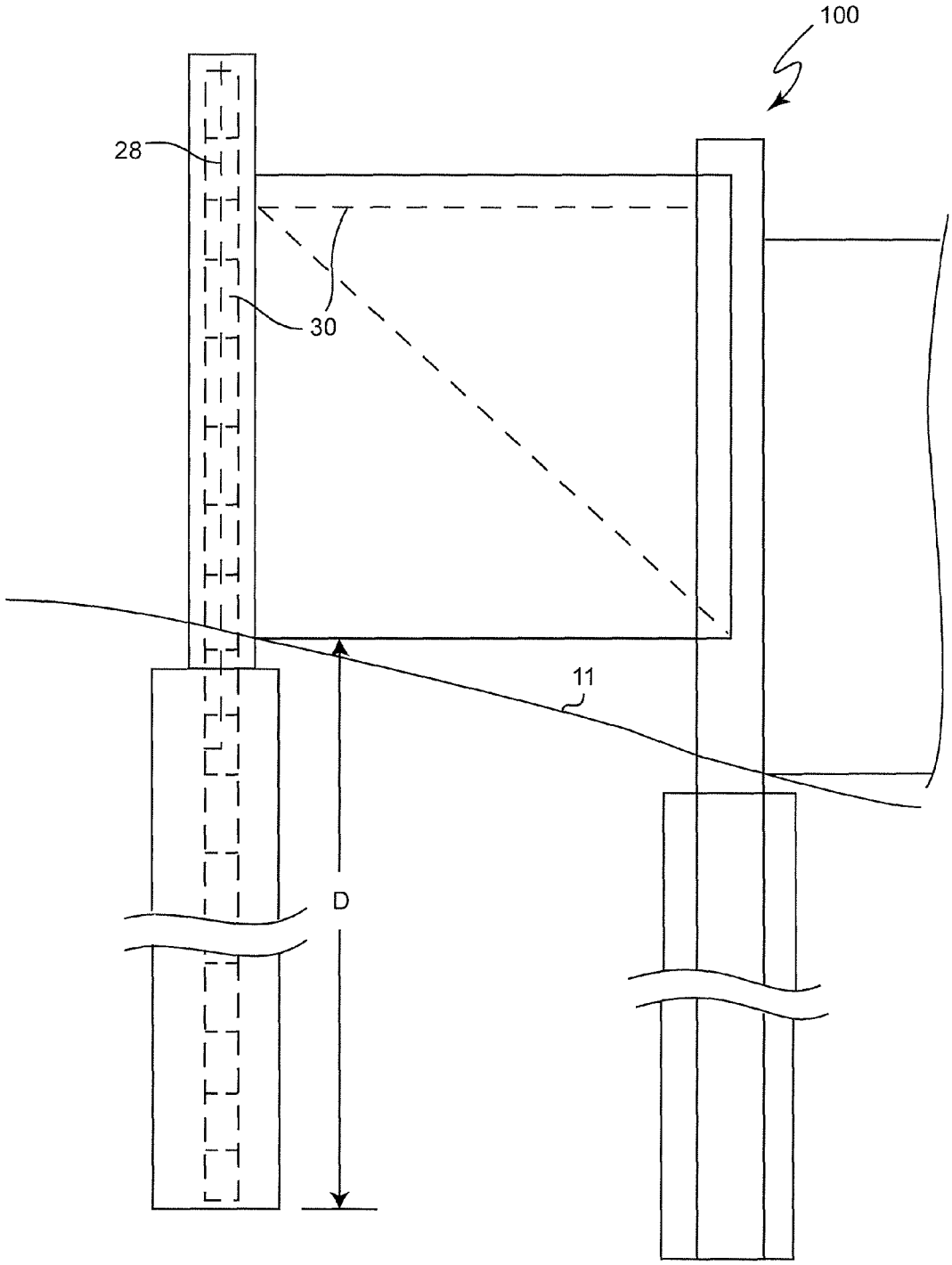
FIG. 7 is an elevation view of another embodiment of the invention allowing further simplified construction.

Specifically, referring now to FIG. 7, a further embodiment of the invention is depicted in a manner similar to FIG. 1 and the same reference numerals used in FIG. 1 are applied to corresponding portions of FIG. 7. The embodiment of FIG. 7, differs from that of FIG. 1 principally in the increase in length, D, of the bottom post extension to the full required post depth and spacing for the desired wall height (e.g. twenty-five feet as alluded to above) for the soil type at the location of the wall installation. Reinforcement of the post and panel module may be similar to that discussed above but is preferably continued substantially throughout the post portion of the module and can be pre-stressed over the entire post length. Thus, when installation is complete, the reinforcement effectively provides a substantial degree of reinforcement for the caisson, as well. Otherwise, all features of the invention discussed above apply equally to the embodiment of FIG. 7 and need not be repeated in regard to this embodiment of the invention.

It should be appreciated that the strength of the wall assembled using the embodiment of FIG. 7 will be of somewhat increased robustness and resiliency due to the continuous reinforcement of the bottom post extension over the entire depth of the installation. Stability will be at least as great as that of the embodiment of FIG. 1 since the weight and dimensions of the completed caisson will be substantially the same if designed for the same type of soil. The embodiment of FIG. 7 can be manufactured in the same manner as the embodiment of FIG. 1 and, unless the desired wall height is more than about thirty feet, can be accommodated on flat bed trailers of commercially available dimensions for transportation in the manner described above while no fabrication or transportation of reinforcement cages is required since the reinforcement cage of the embodiment of FIG. 1 is not needed or used in the embodiment of FIG. 7. Omission of the reinforcement cage also reduces the cost of the embodiment of FIG. 7 in comparison with the embodiment of FIG. 1. Thus, the advantages of the embodiment of FIG. 1 will all be enhanced to some degree in the embodiment of FIG. 7.

Figure 8:
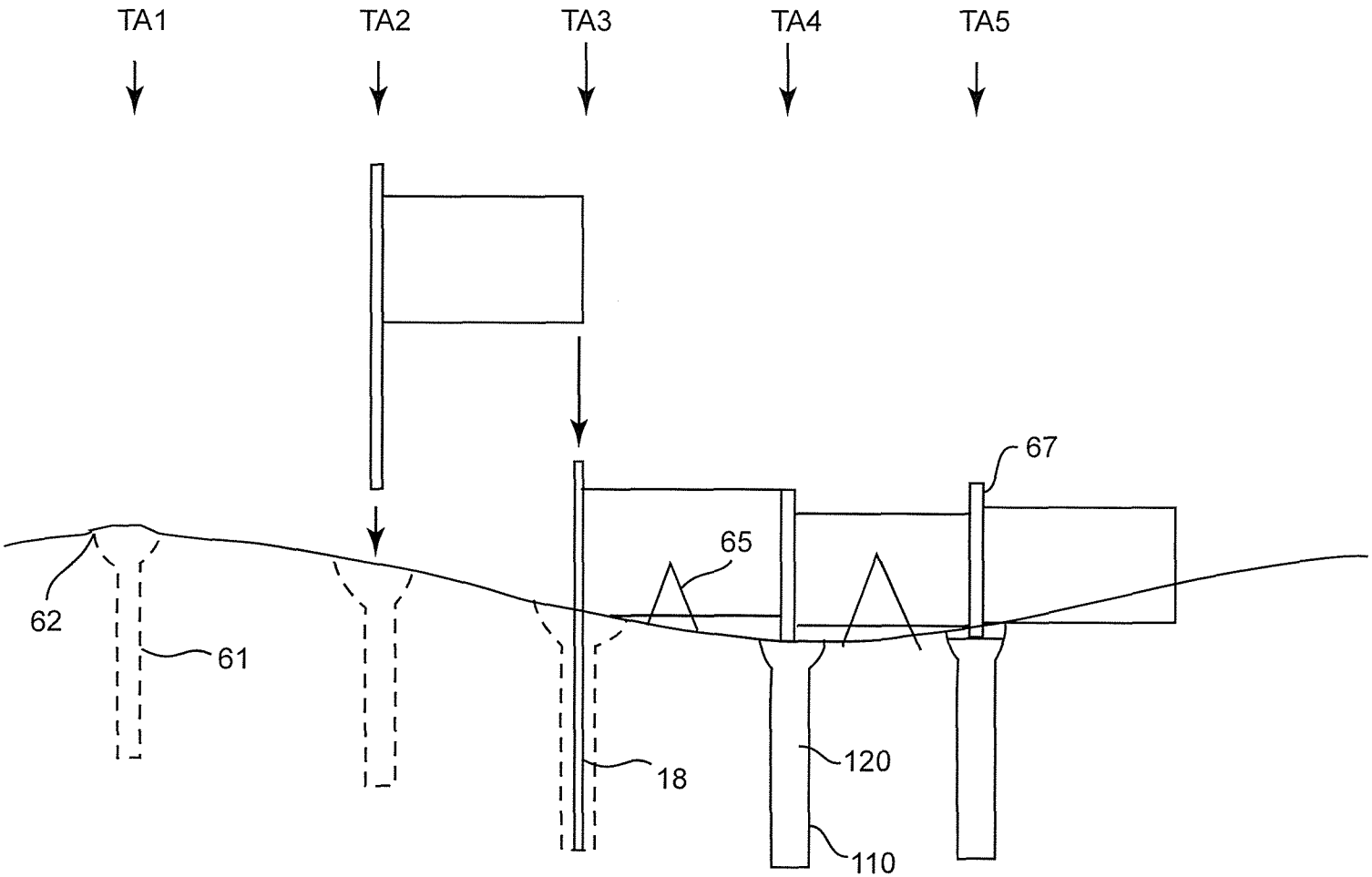
FIG. 8 illustrates the simplified construction procedure provided by the embodiment of the invention illustrated in FIG. 7.

The principal advantage of the embodiment of FIG. 7 over that of FIG. 1 is in the simplification of wall construction and installation and the consequent reduced time required to do so as will be apparent from a comparison of FIG. 8, illustrating construction and installation of the embodiment of FIG. 7. As with FIG. 6, the process steps for installation for a given panel and post module proceeds from left to right in FIG. 8 as indicated by the time sequence TA1-TA5 while the exemplary wall construction process, as illustrated, proceeds from right to left.

As shown at time TA1 of FIG. 8, the installation process begins, as in the embodiment of FIG. 1 with the digging of a post hole 62, preferably by drilling in view of the depth that may be required. The post hole diameter is determined based on soil type and load bearing qualities (e.g. compressibility) to develop sufficient surface area to bear against the soil when anticipated loads are placed on the panel section. The upper portion 61 of posthole 62 is preferably enlarged somewhat, as before, to provide increased bearing surface against the surrounding soil where forces due to wind and the like will be increased. Once a satisfactory post hole is formed, the panel and post module 100 may be set in place as indicated at TA2, to engage slot 28 of a previously installed module (or a starting terminal post) and alignment adjusted and secured with bracing 65, as illustrated at TA3. Then, the caisson 110 can be formed, preferably in a single concrete pour 120 into the post hole 61, 62 to surround the lower post portion extension 18 as illustrated at TA4. So-called self-consolidating or self-leveling concrete is preferred since it does not require compaction and tends to form a better bond with the post portion of the wall module and a better quality interface with the surrounding soil. Once the concrete has cured sufficiently, bracing 65 can be removed and the installation of the post and panel module is complete.

It should be appreciated from a comparison of FIG. 8 with FIG. 6 that the embodiment of FIG. 7 simplifies the process by essentially allowing the installations stages T2 and T3 of FIG. 6 to be omitted. However, it should be appreciated that the process illustrated in FIG. 6 requires two separate concrete pours and corresponding curing times while the process of FIG. 8 requires only a single pour and curing time. Thus, the time elapsed between processes TA2 (after the post hole is formed) and TA5 of FIG. 8 is only about one half of the duration between operations T2 and T7 of FIG. 6.

Perhaps more importantly, the period of time from when the post hole is formed to the concrete pour for the caisson (e.g. TA2 to TA4; the period personnel are engaged in placement of a post and panel module) is very short and, since the bracing 65 can be removed at any time after the concrete cure is complete, (assuming that a separate crew will be forming the post holes since a post and panel module can be set in place in far less time than is required to form a post hole) requires only a single crew and a single set of machinery. In contrast, assuming the wall is relatively long, the corresponding period in FIG. 6 stretches from T2 to T5 and, for most rapid construction, requires a minimum of two crews, working several days apart, and two sets of machinery for the process of FIG. 6. Therefore, using the embodiment of FIG. 7, wall installation and construction can proceed much more rapidly with fewer personnel and less machinery; realizing a substantial cost savings in addition to saving the cost of manufacturing and transporting reinforcement cages required in the embodiment of FIG. 1 while, as discussed above, the embodiment of FIG. 1 provides a major simplification of construction and reduction in construction time and labor over a wall design constructed from separate posts and panels.

In view of the foregoing, it is seen that the invention provides a post and panel module for construction of a wall which provides substantial economies in the manufacture of the post and panel module with simplified casting forms or equipment, substantial economies of transportation of the modules to the construction site and even further economies in assembly and construction of walls through enabling use of a single sequence of operations which can be completed quickly and with minimal equipment and movement thereof. Moreover, the invention provides a completed wall of superior robustness, strength, stability and safety while minimizing costs of repairs which may be caused by settling, shifting or damage, particularly as applied to walls which form an acoustic barrier.

While the invention has been described in terms of a single preferred embodiment, those skilled in the art will recognize that the invention can be practiced with modification within the spirit and scope of the appended claims.

Having thus described my invention, what I claim as new and desire to secure by Letters Patent is as follows:

1. A module for construction of a wall comprising
- a panel portion integrally formed of a rigid material with and cantilevered from a post portion, said post portion including
- a groove for receiving a distal end of a panel portion of an adjacent module such that said adjacent panel portion is supported to relieve stress from a post portion of said adjacent module that is due to said panel portion being cantilevered therefrom,
- a top post extension portion for accommodating the entirety of said distal portion of said panel portion of said adjacent module when said adjacent module and said module are installed at different heights, and
- a bottom post extension portion for being integrated with a pier or caisson and of a length for extending into said pier or caisson to a depth sufficient to support said module in soil.

2. A module as recited in claim 1 wherein said groove is aligned with said panel portion of said module.

3. A module as recited in claim 2 including a further groove formed at an angle to said panel portion of said module.

4. A module as recited in claim 3, wherein said angle is 90°.

5. A module as recited in claim 1 wherein said groove is formed at an angle to said panel portion of said module.

6. A module as recited in claim 5, wherein said angle is 90°.

7. A module as recited in claim 5 including a further groove formed at an angle to said panel portion of said module.

8. A module as recited in claim 7, wherein said angle of said further groove is 90°.

9. A module as recited in claim 1, wherein said bottom extension is integrated with a pier or caisson by casting concrete around said bottom extension within a post hole to form said pier or caisson.

10. A module as recited in claim 1, wherein said top post extension has a length corresponding to a change in grade over the length of a said panel portion of the site on which said module is to be installed.

11. A modular wall comprising a plurality of wall modules, each wall module of said plurality of wall modules comprising
- a panel portion integrally formed of a rigid material with and cantilevered from a post portion, said post portion including
- a groove for receiving a distal end of a panel portion of an adjacent module such that said adjacent panel portion is supported to relieve stress from a post portion of said adjacent module that is due to said panel portion being cantilevered therefrom,
- a top post extension portion for accommodating said distal portion of said panel portion of said adjacent module when said adjacent module and said module are installed at different heights, and
- a bottom post extension portion, said modular wall further comprising
- a caisson or pier integrated with said bottom post extension portion, said bottom post extension extending into said pier or caisson to a depth sufficient to support said module in soil.

12. A modular wall as recited in claim 11, wherein said caisson or pier includes a reinforcement cage including an exposed portion adapted to receive said bottom post extension portion.

13. A modular wall as recited in claim 12, wherein said exposed portion of said reinforcement cage extends at least five feet from said pier or caisson.

14. A modular wall as recited in claim 12, wherein said reinforcement cage and said bottom post extension portion are encased in concrete.

15. A method of constructing a modular wall including an integrated panel and post module including steps of
- forming a post hole to a depth sufficient to support said panel and post module in soil,
- positioning a wall module comprising
  - a panel portion integrally formed of a rigid material with and cantilevered from a post portion, said post portion including
  - a groove for receiving a distal end of a panel portion of an adjacent module such that said adjacent panel portion is supported to relieve stress from a post portion of said adjacent module that is due to said panel portion being cantilevered therefrom, and
  - a bottom post extension portion such that said bottom post extension portion extends to substantially said depth within said post hole and said distal end of said panel portion is received in said groove of an adjacent module, and
- pouring a material to encapsulate said bottom post extension and form a pier or caisson integral with said bottom post extension portion.

16. A method as recited in claim 15, wherein said wall module further includes
- a top post extension portion for accommodating the entirety of said distal portion of said panel portion of said adjacent module when said adjacent module and said module are installed at different heights.

17. A method as recited in claim 16 including the further step of removing a portion of said top post extension portion above a location of the top of a panel portion of an adjacent wall module.

18. A method as recited in claim 15, wherein said material is concrete.

19. A method as recited in claim 15, wherein said step of positioning said wall portion places part of said panel portion below grade.

20. A method as recited in claim 15, wherein an upper portion of said post hole is larger than a lower portion of said post hole.

* * * * *